US006671965B2

(12) United States Patent
Clemens et al.

(10) Patent No.: US 6,671,965 B2
(45) Date of Patent: Jan. 6, 2004

(54) DIAMOND-TIPPED INDENTING TOOL

(75) Inventors: Reade Clemens, Plainville, CT (US); Dilip M. Shah, Glastonbury, CT (US); David Lee Roe, East Hampton, CT (US)

(73) Assignee: United Technologies Corporation, Hartford, CT (US)

( * ) Notice: Subject to any disclaimer, the term of this patent is extended or adjusted under 35 U.S.C. 154(b) by 54 days.

(21) Appl. No.: 10/034,417

(22) Filed: Dec. 28, 2001

(65) Prior Publication Data

US 2003/0121159 A1 Jul. 3, 2003

(51) Int. Cl.[7] ..... B26B 3/00
(52) U.S. Cl. ..... 30/164.9; 30/366
(58) Field of Search ..... 73/85; 30/366, 30/164.9; 125/39; 219/121.64; 228/122.1; 294/1.1

(56) References Cited

U.S. PATENT DOCUMENTS 366,308 A * 7/1887 Derby ..... 30/164.9
1,571,310 A * 2/1926 Wilson ..... 73/85
2,562,587 A * 7/1951 Swearingen ..... 30/164.9
3,138,875 A * 6/1964 Christensen ..... 30/164.9
4,434,651 A 3/1984 Wood
4,560,853 A * 12/1985 Ziegel ..... 219/121.64
4,932,582 A * 6/1990 Une ..... 228/122.1
5,046,357 A 9/1991 Marston
5,133,332 A * 7/1992 Tanaka et al. ..... 125/39
5,785,039 A * 7/1998 Kobayashi et al. ..... 125/39
5,984,391 A * 11/1999 Vanderpot et al. ..... 294/1.1

* cited by examiner

*Primary Examiner*—Hwei-Siu Payer
(74) *Attorney, Agent, or Firm*—Bachman & LaPointe, P.C.

(57) ABSTRACT

The present invention relates to a diamond tipped indenting tool for marking the surface of metal parts. The indenting tool comprises a shank having a tip end and a diamond affixed to the tip end by a braze material. The braze material preferably comprises a braze alloy which wets both the diamond and the material forming the shank. The diamond forms the point of the tool and is preferably a high quality single crystal diamond.

17 Claims, 2 Drawing Sheets

DIAMOND-TIPPED INDENTING TOOL

BACKGROUND OF THE INVENTION

The present invention relates to a diamond-tipped indenting tool which is used to mark the surface of metal parts.

Indenting tools are incorporated within a marking machine and are used to mark parts for identification purposes, or to generate a surface treatment, or a surface condition. In operation, the point of the tool will strike the surface of a part and on impact will create a cold-formed indentation or mark. This is often repeated in various locations to produce a pattern. With continued use, the indenting tool point will eventually wear or break.

Thus, there is a need for an indenting tool that is better able to resist wear or breakage, that can reduce overall tooling costs, improve marking reliability and quality, and support delivery schedules of production parts.

SUMMARY OF THE INVENTION

Accordingly, it is an object of the present invention to provide a diamond tipped indenting tool that has improved wear resistance.

It is a further object of the present invention to provide a diamond tipped indenting tool as above which provides economic benefits.

It is yet a further object of the present invention to provide a diamond tipped indenting tool as above which improves marking reliability and quality.

The foregoing objects are attained by the indenting tool of the present invention.

In accordance with the present invention, an indenting tool broadly comprises a shank having a tip end and a diamond affixed to the tip end by a braze material, with the diamond forming a tip for the tool. The diamond preferably comprises a high quality single crystal diamond. The braze material preferably comprises a brazing alloy which wets both the diamond and the material forming the shank.

Other details of the indenting tool of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
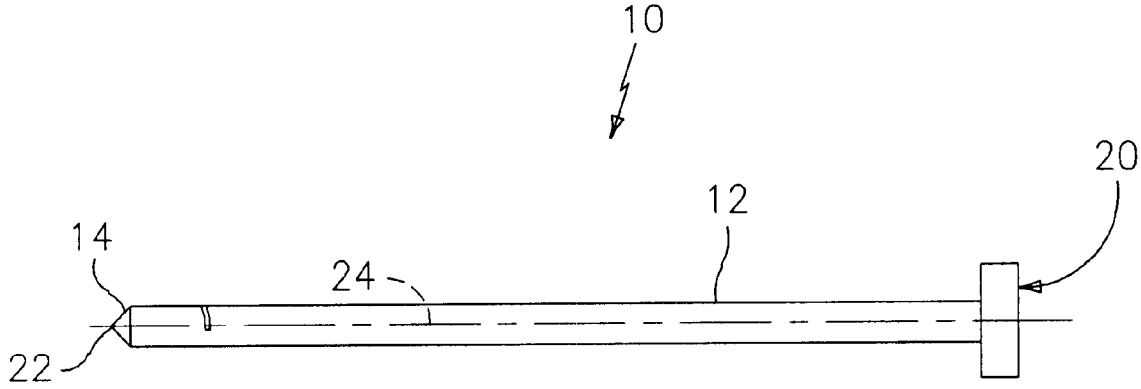
FIG. 1 is a schematic representation of an indenting tool.
Figure 2:
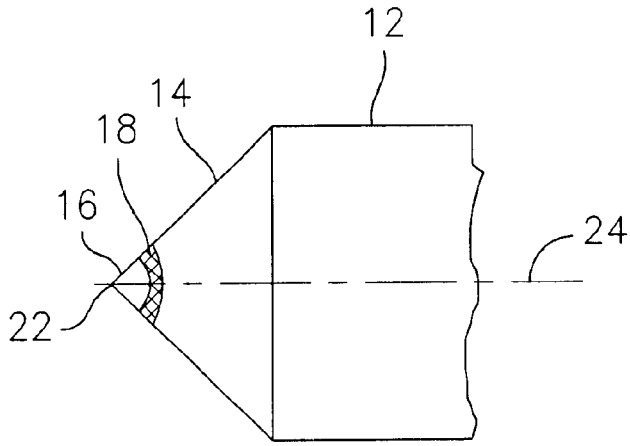
FIG. 2 is an enlarged view of a tip portion of the indenting tool of FIG. 1.
Figure 3:
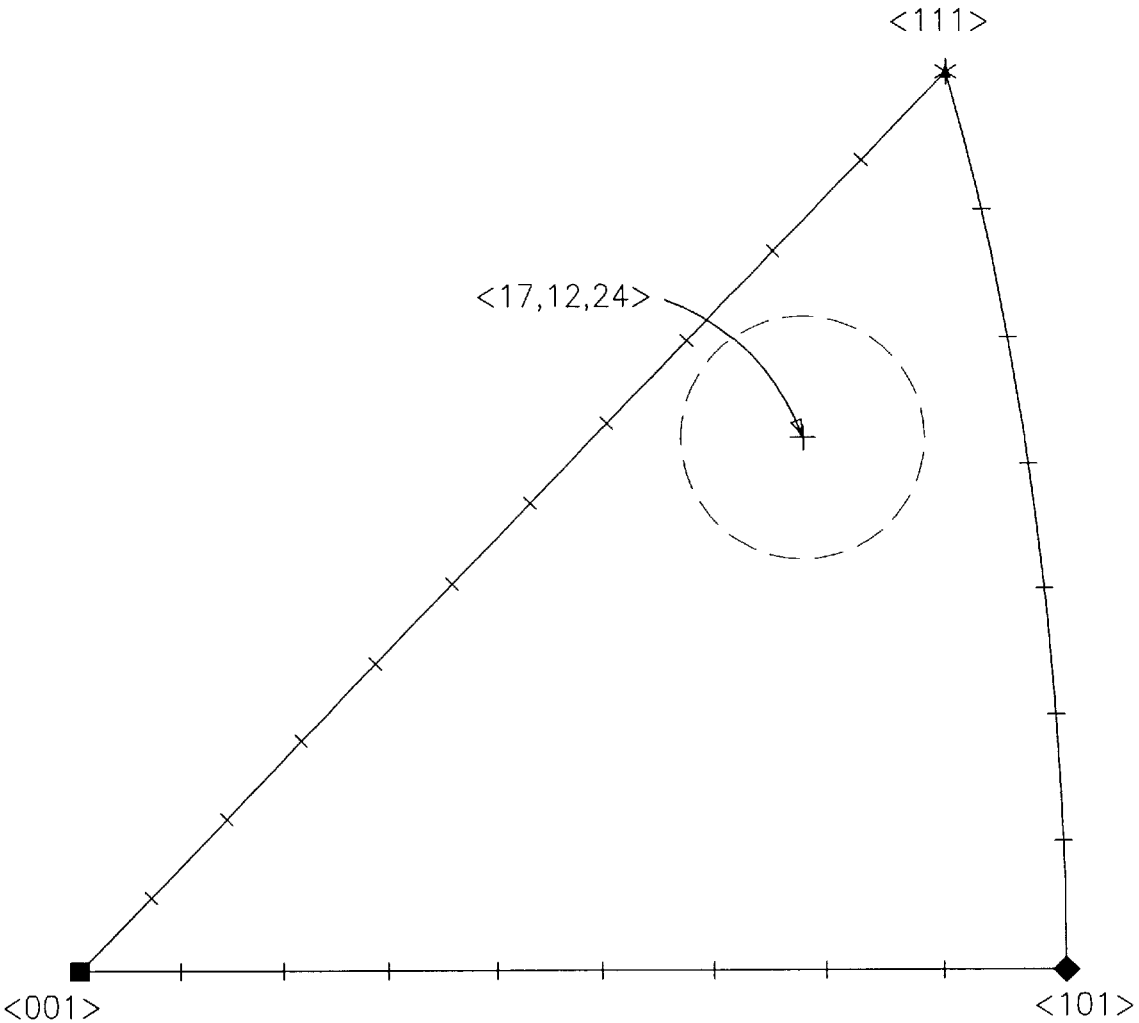
FIG. 3 is a stereographic projection triangle for a diamond crystal to be used in the indenting tool of FIG. 1.

Referring now to FIGS. 1 and 2, an indenting tool 10 in accordance with the present invention has a shank 12 with a tip end 14, a diamond 16 forming the tip of the tool 10, and a braze material 18 for joining the diamond 16 to the tip end 14. Preferably, the tip end 14 is tapered as shown in FIG. 2. The orientation of the diamond's crystal, as provided in the stereographic projection triangle shown in FIG. 3, is preferably aligned with the shank axis 24.

The shank 12 is formed from at least one material selected from the group consisting of stainless steel, hardenable tool steel, a cemented carbide material, and combinations thereof. The shank 12 may also have a head 20 at a second end opposite the tip end 14. The head 20 may be integrally formed with the shank 12 or may be joined to the shank 12 by a welding or brazing material or by a press fitting operation. The shank 12 and the head 20 can vary dimensionally to meet marking requirements and/or to complement the marking machine in which the tool will operate. Typically, the head 20 is wider than the shank 12. Still further, the head 20 can be made from the same material as or a different material from that forming the shank 12.

The brazing material 18 preferably comprises a brazing alloy which wets the diamond 16 and the material forming the shank 12. A suitable brazing material 18 is any suitable silver copper braze material known in the art. The silver copper braze material may contain a minor addition of a reactive element.

The diamond 16 is preferably a high quality single crystal diamond. The diamond should be free of defects such as inclusions, porosity, or cracks because such defects can cause significant reductions in tool life. However, minor defects may be present in the loose diamond if they can be removed by grinding once mounted, or if they can be relegated to a position far from the working point 22 of the diamond.

The diamond stone size should allow for sufficient length at least greater than the indentation depth when finish ground. Using a larger diamond stone is not detrimental to the operation of the tool 10.

To assemble the tool 10, the diamond 16 is inspected to determine the intrinsic crystallographic directions. Then the diamond 16 is brazed to the shank tip 14 in a particular orientation as provided in the stereographic projection triangle shown in FIG. 3. For cubic crystal structures such as diamonds, a stereographic projection triangle is a useful tool to graphically display all possible crystal orientations. In FIG. 3, reference common crystal directions are identified at the corners. A very desirable super wear-resistant indenting performance can be achieved by mounting the diamond in the <17,12,24> direction shown in FIG. 3 or within 5 degrees from this direction denoted by the dotted line in FIG. 3. Proper positioning of the diamond 16 can be verified using X-ray diffraction techniques in the as-brazed condition or in the finish ground condition. With regard to the brazing of the diamond 16 to the shank 12, a vacuum brazing process is preferred over brazing in air for better wetting of the braze alloy. Any suitable vacuum brazing process known in the art may be used to mount the diamond 16 to the shank 12.

After brazing, the tool point 22 is final ground and/or lapped to a geometry determined by the desired shape of the part indentation. The tool point 22 may be a 90 degree or 120 degree included angle conical and can be used in the as-sharp condition or after a small radius is lapped onto the point 22.

If desired, the diamond 16 may be a synthetic single crystal diamond. Benefits associated with using a synthetic diamond include elimination of internal defect concerns normally associated with natural diamonds and possibly greater control over the crystal orientation.

By incorporating diamonds without internal defects, such as inclusions, porosity, or cracks, major reductions in diamond tool life for impact applications can be prevented. This is because the diamond does not have those defects which cause premature fracture during service.

The tool 10 shown in FIG. 1 may extend 4 inches from an end of the head 20 to the tip of the diamond 16. The shank 12 may have a diameter of one eighth of an inch.

It is apparent that there has been provided in accordance with the present invention a diamond tipped indenting tool which fully satisfies the objects, means and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. An indenting tool comprising:

a shank having a tip end;

a diamond affixed to said tip a braze material, said diamond forming a point of the tool; and said diamond being mounted to said tip end in a <17, 12, 24> direction.

2. An indenting tool according to claim 1, wherein said shank is formed from at east one of a hardened tool steel, stainless steel, and a cemented carbide.

3. An indenting tool according to claim 1, further comprising a head formed adjacent a second end of said shank.

4. An indenting tool according to claim 3, wherein said head is wider than said shank.

5. An indenting tool according to claim 1, wherein said diamond is a single crystal diamond.

6. An indenting tool according to claim 1, wherein said diamond is a single crystal diamond nearly free of defects.

7. An indenting tool according to claim 1, wherein said diamond comprises a synthetic single crystal diamond.

8. An indenting tool according to claim 1, wherein said diamond in a final ground state has a length greater than an indentation depth to be imparted to a part to be marked.

9. An indenting tool according to claim 1, wherein said diamond has a 90 degree included angle conical point.

10. An indenting tool according to claim 1, wherein said diamond has a 120 degree included angle conical point.

11. An indenting tool according to claim 1, wherein said braze material comprises brazing alloy which wets both said diamond and the material forming said shank.

12. An indenting tool according to claim 1, wherein said tip end of said shank is tapered.

13. An indenting tool comprising:

a shank having a tip end;

a diamond affixed to said tip end by a braze material, said diamond forming a point of the tool; and said diamond being mounted to said tip end within 5 degrees of a <17, 12, 24> direction.

14. An indenting tool comprising:

a shank having an end;

a diamond secured to said end in a wear resistant orientation; and said wear resistant orientation being approximately a <17, 12, 24> direction.

15. An indenting tool comprising:

a shank having an end;

a diamond secured to said end in a wear resistant orientation; and said wear resistant orientation being within approximately 5° of a <17, 12, 24> direction.

16. A method of making an indenting tool, comprising the steps of:

providing a shank having an end;

providing a diamond;

positioning said diamond in a wear resistant orientation;

securing said diamond to said end; and said positioning step positioning said diamond in a wear resistant orientation of approximately a <7, 12, 24> direction.

17. A method of making an indenting tool, comprising the steps of:

providing a shank having an end;

providing a diamond;

positioning said diamond in a wear resistant orientation;

securing said diamond to said end; and said positioning step comprising positioning said diamond in a wear resistant orientation of within approximately 5° of a <17, 12, 24> direction.

* * * * *

UNITED STATES PATENT AND TRADEMARK OFFICE

CERTIFICATE OF CORRECTION

PATENT NO. : 6,671,965 B2
APPLICATION NO. : 10/034417
DATED : January 6, 2004
INVENTOR(S) : Reade Clemens et al.

It is certified that error appears in the above-identified patent and that said Letters Patent is hereby corrected as shown below:

In column 3, claim 1, at line 3, after "a diamond affixed to said tip" insert "end by".
In column 4, claim 16, at line 29, after "said positioning step" insert "comprising".

Signed and Sealed this

Twenty-second Day of August, 2006

JON W. DUDAS
*Director of the United States Patent and Trademark Office*